United States Patent [19]

Boczewski

[11] 4,220,287

[45] Sep. 2, 1980

[54] PROCESS FOR THE TREATMENT OF OATS

[75] Inventor: Michael P. Boczewski, Statesville, N.C.

[73] Assignee: Maple Leaf Mills Limited, Toronto, Canada

[21] Appl. No.: 12,334

[22] Filed: Feb. 15, 1979

[30] Foreign Application Priority Data

Mar. 23, 1978 [GB] United Kingdom ..... 11805/78

[51] Int. Cl.[3] ..... B02C 4/06; B02C 9/04

[52] U.S. Cl. ..... 241/9; 241/12; 241/13

[58] Field of Search ..... 241/7–13, 241/21, 60, 62

[56] References Cited

U.S. PATENT DOCUMENTS

| | | | |
|---|---|---|---|
| 2,131,674 | 9/1938 | Salomon et al. | 241/12 X |
| 2,482,141 | 9/1949 | Boatner et al. | 241/12 X |

OTHER PUBLICATIONS

"Chemistry of Oats: Protein Foods & Other Industrial Products", Shukla, T. P., Oct. 1975, *Critical Reviews in Food Science & Nutrition.*

*Primary Examiner*—Mark Rosenbaum

[57] ABSTRACT

A process for the separation of dehulled oats into fractions differing in composition is disclosed. The process comprises admixing comminuted dehulled oats with a solvent for oat oil and separating the admixture into at least two fractions, the solid components of which differ in composition. The comminuted oats used in the process are oats that have been comminuted by passing dehulled oats between at least one pair of rollers spaced apart at a distance of not more than 0.75 mm. Preferably at least one pair of rollers is spaced apart at a distance of 0.025–0.25 mm. The rollers may be smooth-surfaced or rough-surfaced rollers. The process is useful in the separation of a variety of products e.g. endosperm, bran and oil, from oats.

8 Claims, 1 Drawing Figure

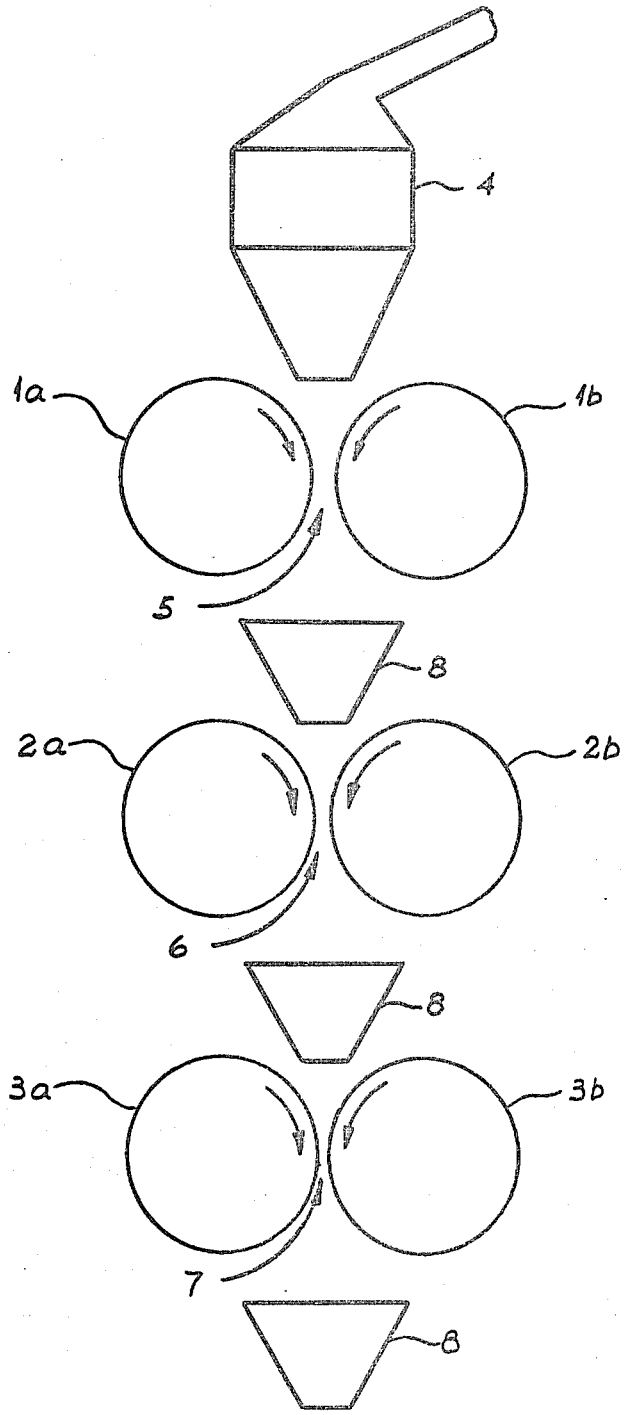
4
1a
1b
5
8
2a
2b
6
8
3a
3b
7
8

PROCESS FOR THE TREATMENT OF OATS

The present invention relates to a process for the treatment of comminuted oats so as to effect separation of the comminuted dehulled oats i.e. comminuted groats, into fractions differing in composition. In particular the invention relates to such a process in which the groats have been comminuted by passage between at least one pair of rollers.

As used herein the expression "groats" refers to the kernel of the oat, the expression "flour" refers to the endosperm of the oat and the expression "bran" refers to the bran of the oat, such bran may have endosperm attached thereto. The expression "gum" refers in particular to water-soluble gum.

Oats are a potential source of a wide variety of useful products. Examples of such products are flour, starch, protein concentrates, bran, gum and oil.

The milling of oats is discussed by T. P. Shukla et al in "Chemistry of Oats: Protein Foods and Other Industrial Products", Critical Reviews in Food Science and Nutrition, October 1975, pp 383–431, especially pp 407–413. In a discussion on the production of high protein concentrates by air-classification, Shukla et al note that prior pinmilling is desirable for the separation of protein concentrates and that an air-classification process is simpler and more economical than a wet-milling process. Air classification of oat flour is stated to yield a fraction (2–5% of the total oat) that contains 83–88% by weight of protein.

Pinmills are relatively expensive to purchase and operate, and in operation are generally characterized by relatively low throughput, in kilograms/hour, the requirement for a large air flow and by the non-selective nature of the comminution. Hammermills usually have a higher throughput but require the use of a screen which tends to become plugged with oily comminuted material. The use of a hammermill may also result in the input of heat into the groats to the extent that subsequent separation of protein may be affected detrimentally.

While air-classifying techniques may be used to separate fractions of high protein content from oats, such techniques require the use of comminuted oats of small particle size, for example, as obtained by pinmilling, and the product obtained is susceptible to contamination by significant amounts of oat gum and bran. Although the processes of Oughton referred to hereinbefore do result in flour and protein fractions essentially free of gum, such processes preferably utilize pinmilled oats or the like. There is a need for a process that is capable of producing fractions of high protein content and which utilizes comminuted oats that have been comminuted in a more economical manner.

It has now been found that dehulled oats may be separated into fractions of differing composition in a process that utilizes groats that have been comminuted by passage between rollers.

Accordingly the present invention provides a process for the separation of dehulled oats into fractions differing in composition, said process comprising:

(a) admixing comminuted dehulled oats with an organic solvent, said oats having been comminuted by passing dehulled oats between at least one pair of rollers, the rollers of each pair being smooth-surfaced rollers spaced apart at a distance of not more than 0.75 mm, at least one pair of rollers being spaced apart at a distance of 0.025–0.25 mm, and said solvent being a solvent for oil in the oats, and (b) separating the admixture of comminuted oats and solvent into at least two fractions, the solid components of said fractions differing in composition.

In a preferred embodiment of the process of the present invention, the dehulled oats are passed between at least two pairs of rollers.

The oats used in the process of the present invention are dehulled oats. Techniques for dehulling oats are known in the art. The dehulled oats i.e. groats, are comminuted in order to facilitate separation of the comminuted groats so obtained into fractions differing in composition, for example a flour fraction and a bran fraction.

In the process of the present invention the groats are comminuted by passing groats between at least one pair of rollers. Such comminution of groats is illustrated by the embodiment of the drawing which is a schematic representation of apparatus for comminution of groats using rollers.

Referring to the drawing the apparatus shown for the comminution of dehulled oats comprises pairs of rollers 1*a*/1*b*, 2*a*/2*b* and 3*a*/3*b* and a feed chute generally indicated by 4. In the embodiment shown, the pairs of rollers are spaced in a vertical arrangement with first gap 5, between rollers 1*a* and 1*b*, being vertically above second gap 6, between rollers 2*a* and 2*b*, and third gap 7, between rollers 3*a* and 3*b*. Such a vertical arrangement is not essential although if the arrangement is not vertical means to transport material passing through, for example, first gap 5 to a location above second gap 6 may be required so as to permit the material to enter second gap 6. Each pair of rollers are biased together by means of springs (not shown) adapted to maintain the size of the gap under normal operation.

In the embodiment shown in the drawing first gap 5 is wider than second gap 6 i.e. rollers 1*a* and 1*b* are spaced further apart than rollers 2*a* and 2*b*. Similarly second gap 6 is wider than third gap 7. However in a preferred embodiment of the process of the present invention the gaps 5, 6 and 7 are nominally of the same size and are at or close to the minimum operable gaps between the pairs or rollers. The minimum gaps must be such that the pairs of rollers do not touch during operation even if the rollers become heated under operating conditions, as the touching of rollers may result in damage to the rollers and contamination of the comminuted oats.

Feed chute 4 is located above first gap 5. Feed chute 4 is adapted to guide and/or convey groats from a source thereof, not shown, to a location above first gap 5. Feed chute 4 may operate solely using the effects of gravity or may embody other techniques e.g. use of vibrators, to assist in the conveying of the groats. Although a feed chute has been shown in the embodiment of the drawing other means known to those skilled in the art, for example feeder rolers, may be used to supply groats to first gap 5.

In the embodiment shown in the drawing a guide chute is located under each gap between pairs of rollers, for example under first gap 5, to guide comminuted groats passing through the gap to the next step of the process i.e. further comminution between pairs of rollers or a subsequent step in the process (not shown).

In operation groats are fed down feed chute 4 at a controlled rate, the rate normally being controlled so as to maintain first gap 5 full or essentially full of oats. The groats are comminuted, primarily by crushing, as the groats pass through first gap 5. The degree of comminution of the groats on passage through first gap 5 will depend in particular on the size of first gap 5 i.e. the distance between roller 1*a* and roller 1*b*. The size of the gap between rollers is discussed further hereinbelow. The comminuted groats from first gap 5 may then be passed in turn through guide chute 8 to second gap 6, third gap 7 and thence to the next step in the process. However while the embodiment of the drawing shows the comminuted groats from, for instance, first gap 5 being fed to the next step in the process, it is to be understood that the comminuted groats may be collected, sieved and/or stored for a period of time before being fed to the next step of the process. Moreover the comminuted groats could be fed to the first pair of rollers again, instead of being fed to a second pair of rollers, such feeding being in batches to ensure uniform comminution.

Although the comminution of the groats has been described with reference to the use of three pairs of rollers, comminution may be accomplished with only one pair of rollers. More than one pair is preferred for ease of operation and uniformity of product.

The rate of feeding groats to the first pair of rollers may effect the degree of comminution of the groats. If the rollers are "flood" fed it is possible that the groats passing between the rollers will force the rollers apart, thereby permitting whole groats or large pieces of groats to pass through. In addition, a subsequent pair of rollers more narrowly spaced apart than a previous pair may affect the rate of feeding to the first pair of rollers. The manner of feeding the groats to the rollers is also important and should be so as to give a uniform feed of groats across the rollers.

The size of the gap between rollers primarily determines the degree of size reduction on passage of the groats between a pair of rollers. If only one pair of rollers are used, the gap between the rollers is in the range of 0.025–0.25 mm. If more than one pair of rollers are used, the gap of one pair, preferably the last pair, of rollers is in the range 0.025–0.25 mm with the gap between any one pair of rollers being not more than 0.75 mm. Whenever more than one pair of rollers is used, the first gap may be the largest with the gaps getting progressively smaller until the last gap is reached but preferably all gaps are the same size and are the minimum operable gaps. The rollers should not be so close that the rollers touch as in such event the comminuted groat may become contaminated with particles, usually metallic particles, of the material of the rollers.

The speed of the rollers may be varied over a wide range. Suitable speeds are exemplified hereinafter. The rollers counter-rotate so as to force the groats through the gap between the rollers. Any differential in speed between the rollers results in a shearing action, in addition to the crushing action of the rollers. Such a shearing action may be beneficial, as is exemplified hereinafter, although a higher level of fine bran particles may result.

The moisture content of the groats may affect the comminution of the groats. It is however believed to be preferable not to heat the groats in order to dry such, it being preferred to subject the groats to additional comminution rather than drying.

The rollers used in the comminution of the groats have smooth surfaces i.e. polished surfaces. Preferably the surfaces are $<10$ rms polished surfaces. Such surfaces may be obtained by fine grinding and polishing, as is known to those skilled in the art. Scraper blades or brushes may be used with the smooth rollers to remove any oil or other material on the rollers. The rollers, which may be cooled rollers, are preferably ground hardened steel rollers.

In the process of the present invention, the comminuted groats obtained as described hereinabove are admixed with an organic solvent for the oil in the oats. Such admixing facilitates extraction of any oil. The organic solvent must also be acceptable for use with foodstuffs e.g. be non-toxic at the levels remaining in the products subsequently produced, not cause the formation of toxic materials in the product and not have a significant deleterious effect on the nutritional value of the product, and must be capable of permitting separation of the fractions. The amount and type of solvent remaining in products offered for sale must be acceptable to the appropriate health authorities, as will be understood by those skilled in the art. Examples of solvent are pentane, hexane, heptane, cyclohexane and alcohols of 1–4 carbon atoms, and mixtures thereof; as used herein the solvent hexane and heptane include those solvents referred to in the food industry as hexane and heptane. The preferred solvent is hexane. The present invention will generally be described hereinafter with reference to hexane as solvent.

In the process the comminuted groats are admixed with the organic solvent e.g. hexane. Such admixing is preferably carried out with agitation e.g. stirring and may be so as to form a slurry. The total period of time during which the comminuted groats and hexane are admixed should be such that the desired degree of extraction of any oil from the comminuted groats is achieved, the period of time being dependent in part on the actual technique of extraction. Generally a slurry of comminuted groats and hexane will be used.

The separation of the fractions of comminuted groats may be carried out by one ore more embodiments of the separation step of the process of the present invention. The preferred embodiment will depend in particular on the particular proteinaceous material and on the desired products.

In one embodiment the admixture of comminuted groats and hexane is thoroughly mixed using for example a stirrer. The admixing may then be adjusted to effect separation of fractions of the comminuted groats. For example if mixing is discontinued one fraction, which contains the bran, tends to settle significantly faster than a second fraction comprised of flour. Separation may be effected by for example decantation. Alternatively a separation may be effected by sieving the admixture. The mesh size of the sieve will depend primarily on the degree of separation desired. Preferably a sieve having a fine mesh e.g. 200 or finer, is used. The bran fraction will tend to be retained on the sieve and may be used as such or subjected to further comminution and subsequent further separation into fractions. The flour fraction tends to pass through the sieve.

In another embodiment the stirring of the admixture of comminuted groats and hexane is controlled so that the separation of the comminuted groats into fractions occurs in situ i.e., a non-uniform distribution of the comminuted groats occurs in the admixture. Separation of one fraction from the admixture may be effected by adding additional solvent, preferably in a continuous manner, and removing, preferably simultaneously removing, a fraction of the comminuted groats in hexane.

In a further embodiment the admixture of comminuted groats and hexane is admixed in the form of a slurry and then subjected to the influence of centrifugal force. The means used to subject the slurry to centrifugal force is a centrifugal separator, preferably a centrifugal separator capable of being operated on a continuous or semi-continuous basis. Examples of centrifugal separators are continuous centrifuges, uncluding semi-continuous centrifuges, and hydrocyclones.

In a preferred embodiment, particularly with respect to the use of centrifugal force, the material which is subjected to separation is a proteinaceous fraction derived from groats comminuted by means described herein. In particular the material subjected to the influence of centrifugal force is a flour or protein fraction that has been obtained by classifying an admixture of comminuted groats and hexane e.g. by sieving, decanting and the like as described hereinabove.

In general in the embodiments of the present invention, the fractions obtained will comprise at least 5%, and preferably at least 20%, of the comminuted groats or of the proteinaceous fraction derived therefrom.

The use of the influence of centrifugal force on proteinaceous fractions derived from comminuted proteinaceous material, rather than on the comminuted material per se, may be advantageous in that process problems associated with large particles e.g. the clogging of hydrocyclones, may be reduced or avoided. In particular flour fractions may be subjected to the influence of centrifugal force in a continous centrifuge or hydrocylone. Proteinaceous fractions, especially flour fractions, may be subjected to single or multiple treatments under the influence of centrifugal forces to produce a variety of products, especially products of varying protein content.

In a particular embodiment of the process of the present invention, a flour fraction derived from groats comminuted as described herein is subjected to the influence of centrifugal force in a centrifuge. After separation of the solvent, e.g. hexane, the cake of solid material obtained may be selectively split into fractions of differing protein content. Techniques for the selective splitting of a centrifuge cake into fractions are known. For example a basket centrifuge may be used as the centrifuge and the fractions may be split out of the basket using a knife blade, as is known for basket centrifuges.

The flour fraction, which may be referred to as endosperm, that is separated according to the process of the present invention is essentially free of any oil in the proteinaceous material. The products of the process of the present invention are believed to be useful in the food industry either as such or as a source of other products. For example flour or endosperm fractions are capable of being used as such or when enriched with protein as nutritional fortifiers in foods, in cereals, baby foods, cakes and the like. The oil obtained is useful in a variety of end uses for example as vegetable oils.

As is illustrated hereinafter the use of rollers in the comminution of groats results in a high yield of flour or endosperm, of high quality, especially endosperm that is relatively uncontaminated by bran. The process is capable of producing very white endosperm products. In one example a comparison of the use of a pair of corrugated rollers followed by two pairs of smooth rollers with the use of only the smooth rollers showed a higher separation of flour or endosperm with only the smooth rollers.

The present invention is illustrated by the following examples.

EXAMPLE I

Hinoat oats, obtained from Agriculture Canada, Ottawa, Ontario were dehulled using a commercial groater and then sized to yield a sample of groats free from hulls. Approximately 250 g of the groats so obtained were fed, by hand, to a STURTEVANT TM roller mill equipped with two smooth rollers each 12.5 cm in width and 20 cm in diameter. The gap between the rollers was 0.075 mm. The mill was adapted to provide a speed differential between the rolers of 2.4:1. The fast roller was rotated at 650 r/min. A "medium" spring pressure was used on the rollers.

A 50 g sample was taken from the comminuted groats that had passed through the roller mill. The remaining comminuted groats were passed through the roller mill a second time. A further 50 g sample was taken and the procedure was repeated to give a total of five samples.

20 g of the first sample (Sample #1) were admixed, in the form of a slurry, with 80 g of hexane at room temperature for 5 minutes. The slurry was then sieved using a 200 mesh TYLER TM screen. The material retined on the screen was re-admixed with 80 g of hexane for 5 minutes and re-sieved using the 200 mesh TYLER screen. The material retained on the screen was again re-admixed with 80 g of hexane for 5 minutes and re-sieved using the 200 mesh TYLER screen. The bran i.e. the material finally retained on the screen, was dried overnight at 40° C. under a pressure of 66.5 kPa in a vacuum oven.

The undersized material i.e. that passing through the screen in each instance, was combined and centrifuged for 10 minutes at 1000 G. The hexane miscella was decanted off and the solid material was admixed, as a slurry, with hexane and centrifuged again. The hexane was decanted off and the solid material thus obtained, viz flour, was dried in the same manner as the bran.

20 g of each of the other four samples were treated in the same manner as the first sample.

The bran and flour samples obtained using the above procedure were analysed for protein using a KJELFOSS TM Automatic 16210 protein analyzer, protein being nitrogen X 6.25.

The results were as follows:

| | Bran | | Flour | | Recovered | Protein Content % | |
|---|---|---|---|---|---|---|---|
| Sample* | wt(g) | %** | wt(g) | % | Weight(g) | Bran | Flour |
| 1 | 6.1 | 32 | 12.0 | 63 | 19.3 | 27.1 | 17.3 |
| 2 | 4.7 | 24 | 13.4 | 69 | 19.3 | 27.1 | 17.3 |
| 3 | 4.2 | 22 | 14.0 | 72 | 19.4 | 26.5 | 17.1 |
| 4 | 4.3 | 22 | 14.2 | 72 | 19.7 | 26.7 | 18.4 |
| 5 | 4.3 | 22 | 13.9 | 72 | 19.4 | 26.3 | 16.8 |

*Estimated weight of oil in each sample ... 1.2 g. The protein content of the sample was 18.9%

**The percentage of bran and flour is based on the recovered weight.

The flour was very white in appearance.

The ash content of the flour and bran was measured by Method 14.007 of the Association of Official Analytical Chemists. The starch damage of the flour was measured by the method disclosed by P. C. Williams and K. S. Segal in "Colorimetric Determination of Damage Starch in Flour" Cereal Chemistry, Vol 47, p 56, 1969.

The results were as follows:

| Sample | Ash (%) Bran | Ash (%) Flour | Starch Damage |
|---|---|---|---|
| 1 | 5.3 | 0.44 | 0 |
| 2 | 6.0 | 0.84 | 0 |
| 3 | 6.2 | 0.87 | 0 |
| 4 | 6.2 | 0.91 | 0 |
| 5 | 6.1 | 0.94 | 0 |

EXAMPLE II

A sample of Hinoat groats was fed to a Laboratory BUHLER TM roller mill equipped with two smooth rollers each 20 cm in width and 15 cm in diameter. The gap between the rollers was 0.025 mm. The rollers of the mill were adapted to provide a speed differential of 2.5:1 between the rollers.

100 g of the rolled groats were admixed, in the form of a slurry, with 250 g of hexane at room temperature for 5 minutes. The slurry was then sieved using a 200 mesh TYLER screen. The material retained on the screen was re-admixed, as a slurry, with 250 g of hexane for 5 minutes and re-sieved using the 200 mesh TYLER screen. The material retained on the screen was again re-admixed with 250 g of hexane for 5 minutes and re-sieved using the 200 mesh TYLER screen. The bran i.e. the material finally retained on the screen, was dried in a vacuum oven for one hour at 45° C.

The undersized material i.e. that passing through the screen in each instance, was combined and centrifuged for 10 minutes at 1000 G. The miscella was decanted off. The solid material thus obtained viz flour, was re-admixed with hexane and re-centrifuged. The flour thus obtained was dried in a vacuum oven for one hour at 45° C. Oat oil was recovered from the combined miscellas using a rotary evaporator.

Protein content and ash were measured as descibed previously.

The results were as follows:

| Sample | Weight(g) | Recovery(%) | Protein Content*(%) | Ash* |
|---|---|---|---|---|
| Bran | 38.2 | 41 | 19.3 | |
| Flour | 48.4 | 51 | 14.8 | 0.87 |

-continued

| Sample | Weight(g) | Recovery(%) | Protein Content*(%) | Ash* |
|---|---|---|---|---|
| Oil | 7.5 | 8 | | |

*Protein content of groats was 17.2%. Ash on starting groats was 2.03.

The flour was very white.

EXAMPLE III

Another 100 g of the rolled groats of Example II were processed in hexane using the procedure described in Example II. The flour sample thus obtained was readmixed with 75 g of hexane, poured into a 43×123 mm extraction thimble which was then placed in a 250 ml centrifuge bottle and centrifuged for 10 minutes at 1000 G. The miscella was decanted off and the thimble, after being allowed to partially dry, was cut open. The centrifuge cake measured 35 mm in depth. Samples of the cake 3 mm in depth were cut from the top, middle and bottom of the cake and analysed for protein. The protein contents were 65.6%, 6.2% and 5.3% respectively indicating that the flour fraction is capable of being segregated into fractions differing in protein content.

EXAMPLE IV

The STURTEVANT roller mill of Example I was modified so that the speed of the rollers, the differential between the speed of the two rollers and the gap between the rollers could be varied. Some of the process variables were then investigated using Hinoat groats that were hand fed to the roller mill.

Bran and flour fractions were obtained from the rolled groats using the procedure of Example II.

The results obtained are given in Table I. The results indicate that the amount of flour tends to increase as the roller speed increases (Runs 1–4), as the roller speed differential increases (Runs 10–15), with increasing number of passes of groats through the roller mill (Runs 16–20), with decreasing roller gap (Runs 21–29) and with increase in the spring pressure on the rollers of the roller mill (Runs 31–37). The moisture of the groats would not appear to have a major effect on the amount of flour obtained.

TABLE I

| Run*** | Spring* Pressure | Passes** | Moisture Content of Groat(%) | Fast Roller, Speed (r/min) | Roller Speed Differential | Roller Gap(mm) | Recovered Weight (%) Bran | Recovered Weight (%) Flour |
|---|---|---|---|---|---|---|---|---|
| 1 | low | 1 | 11 | 160 | 1:1 | 0.05 | 58 | 35 |
| 2 | low | 1 | 11 | 350 | 1:1 | 0.05 | 54 | 39 |
| 3 | low | 1 | 11 | 500 | 1:1 | 0.05 | 47 | 46 |
| 4 | low | 1 | 11 | 650 | 1:1 | 0.05 | 46 | 48 |
| 5 | low | 2 | 11 | 650 | 1:1 | 0.05 | 35 | 55 |
| 6 | low | 1 | 7.4 | 650 | 1:1 | 0.05 | 41 | 53 |
| 7 | low | 1 | 8.4 | 650 | 1:1 | 0.05 | 38 | 55 |
| 8 | low | 3 | 8.4 | 650 | 1:1 | 0.05 | 30 | 64 |
| 9 | low | 1 | 13.4 | 650 | 1:1 | 0.05 | 42 | 51 |
| 10 | low | 1 | 11 | 500 | 1.26:1 | 0.05 | 47 | 47 |
| 11 | low | 3 | 11 | 500 | 1.26:1 | 0.05 | 36 | 58 |
| 12 | low | 1 | 11 | 500 | 2.4:1 | 0.05 | 47 | 46 |
| 13 | low | 3 | 11 | 500 | 2.4:1 | 0.05 | 30 | 63 |
| 14 | low | 1 | 11 | 500 | 1:1 | 0.05 | 57 | 36 |
| 15 | low | 3 | 11 | 500 | 1:1 | 0.05 | 41 | 53 |
| 16 | low | 1 | 11 | 500 | 2.4:1 | 0.05 | 47 | 46 |
| 17 | low | 2 | 11 | 500 | 2.4:1 | 0.05 | 34 | 60 |
| 18 | low | 3 | 11 | 500 | 2.4:1 | 0.05 | 30 | 63 |
| 19 | low | 4 | 11 | 500 | 2.4:1 | 0.05 | 26 | 68 |
| 20 | low | 5 | 11 | 500 | 2.4:1 | 0.05 | 25 | 69 |
| 21 | medium | 1 | 10.4 | 500 | 1.25:1 | 0.075 | 36 | 57 |

TABLE I-continued

| Run*** | Spring* Pressure | Passes** | Moisture Content of Groat(%) | Fast Roller, Speed (r/min) | Roller Speed Differential | Roller Gap(mm) | Recovered Weight (%) Bran | Flour |
|---|---|---|---|---|---|---|---|---|
| 22 | medium | 2 | 10.4 | 500 | 1.25:1 | 0.075 | 30 | 64 |
| 23 | medium | 3 | 10.4 | 500 | 1.25:1 | 0.075 | 33 | 61 |
| 24 | medium | 1 | 10.4 | 500 | 1.25:1 | 0.35 | 57 | 37 |
| 25 | medium | 2 | 10.4 | 500 | 1.25:1 | 0.23 | 47 | 47 |
| 26 | medium | 3 | 10.4 | 500 | 1.25:1 | 0.075 | 35 | 59 |
| 27 | medium | 1 | 10.4 | 500 | 1.25:1 | 0.62 | 77 | 17 |
| 28 | medium | 2 | 10.4 | 500 | 1.25:1 | 0.35 | 52 | 42 |
| 29 | medium | 3 | 10.4 | 500 | 1.25:1 | 0.075 | 36 | 59 |
| 30 | high | 1 | 8.8 | 650 | 2.4:1 | 0.075 | 35 | 58 |
| 31 | high | 3 | 8.8 | 650 | 2.4:1 | 0.075 | 28 | 66 |
| 32 | low | 1 | 8.8 | 650 | 2.4:1 | 0.075 | 49 | 45 |
| 33 | low | 3 | 8.8 | 650 | 2.4:1 | 0.075 | 43 | 51 |
| 34 | high | 1 | 8.3 | 650 | 2.4:1 | 0.075 | 37 | 58 |
| 35 | high | 3 | 8.3 | 650 | 2.4:1 | 0.075 | 27 | 68 |
| 36 | low | 1 | 8.3 | 650 | 2.4:1 | 0.075 | 53 | 41 |
| 37 | low | 3 | 8.3 | 650 | 2.4:1 | 0.075 | 45 | 49 |

**no. of times sample of groats passed through roller mill
*spring pressure on rollers, recorded as low, medium or high
***Hinoat groats having a protein content of 26.6% used in all Runs except Runs 30–33 where groats of 18.2% protein content were used. The groats of Runs 21–29 were processed on the BÜHLER mill and not the STURTEVANT mill.

EXAMPLE V

As a comparison and to determine the effect of the use of corrugated rollers, Hinoat groats having a moisture content of 10.4% were fed to a Laboratory BÜHLER roller mill equipped with corrugated rollers. The following procedure was used. In Run 1 of Table II the Laboratory BÜHLER roller mill was equipped with corrugated roller. Bran and flour fractions were obtained from part of the sample of the rolled groats thus obtained using the procedure of Example 1. The remainder of the sample was fed to a STURTEVANT roller mill equipped with smooth rollers. Bran and flour fractions were again obtained (Run 1A) on part of the sample of rolled groats thus obtained. The remainder of the rolled groats were then passed through the STURTEVANT roller mill again. Bran and flour fractions were again obtained (Run 1B). The protein content of the bran fractions were also measured.

The above procedure was repeated using different corrugated rollers and differing gaps between the rollers. In addition a comparative run was carried out in which the groats were fed only to the STURTEVANT roler mill i.e. the groats were not passed through corrugated rolls (Run 7A/7B).

The results and further experimental details are given in Table II.

The highest flour fraction was obtained when the groats had not been passed through corrugated rollers.

TABLE II

| Run | Roller Type* | Roller Gap (mm) | Recovered Weight(%) Bran | Flour | Protein Content, Bran (%) |
|---|---|---|---|---|---|
| 1 | corrugated | 0.20 | 58 | 35 | 22 |
| 1A | smooth | 0.075 | 42 | 52 | 24 |
| 1B | smooth | 0.075 | 37 | 57 | 25 |
| 2 | corrugated | 0.30 | 59 | 34 | 22 |
| 2A | smooth | 0.075 | 34 | 60 | 24 |
| 2B | smooth | 0.075 | 34 | 59 | 25 |
| 3 | corrugated | 0.20 | 38 | 56 | 24 |
| 3A | smooth | 0.075 | 37 | 57 | 26 |
| 3B | smooth | 0.075 | 34 | 60 | 26 |
| 4 | corrugated | 0.30 | 49 | 45 | 23 |
| 4A | smooth | 0.075 | 36 | 58 | 25 |
| 4B | smooth | 0.075 | 38 | 56 | 25 |

TABLE II-continued

| Run | Roller Type* | Roller Gap (mm) | Recovered Weight(%) Bran | Flour | Protein Content, Bran (%) |
|---|---|---|---|---|---|
| 5 | corrugated | 0.20 | 41 | 53 | 24 |
| 5A | smooth | 0.075 | 36 | 58 | 25 |
| 5B | smooth | 0.075 | 34 | 61 | 26 |
| 6 | corrugated | 0.30 | 42 | 52 | 24 |
| 6A | smooth | 0.075 | 34 | 60 | 25 |
| 6B | smooth | 0.075 | 35 | 58 | 26 |
| 7A | smooth | 0.075 | 36 | 57 | 23 |
| 7B | smooth | 0.075 | 30 | 64 | 26 |

*In Runs 1 and 2 the corrugated rollers had 6.4 teeth/cm. In Runs 3 and 4 the corrugated rollers had 8 teeth/cm. In Runs 5 and 6 the corrugated rollers had 10.4 teeth/cm.

EXAMPLE VI

A 7 kg sample of Hinoat groats was fed to a STURTEVANT roller mill using a VIBRA-SCREW TM feeder. The roller mill had smooth rollers having a 2.4:1 speed differential and a roller gap of 0.075 mm. The fast roller was operated at 650 r/min. A moderate spring pressure was used. The rolled groats obtained was twice again fed to the roller mill so that the rolled groats finally obtained had passed through the roller mill three times. Bran and flour fractions were determined using the procedure of Example I. The bran was 30% of the recovered weight and its protein content was 21%. The flour was 63% of the recovered weight and the protein content was 17.5%.

Approximately 4.5 kg of the rolled groats were admixed, as a slurry with 12 l of hexane for 15 minutes. The admixture was passed through SWECO VIBRO-ENERGY SEPARATOR TM equipped with a 325 mesh TYLER screen. Part of the undersized material i.e. that passing through the screen, was centrifuged. A part of the centrifuge cake obtained was added to the remainder of the undersized material until the specific gravity of the latter had been adjusted to 0.80. The resultant admixture was fed, as a slurry and at a pressure of 689 kPa, to a 10 mm hydrocyclone having a 12 mm long vortex finder and a diameter of 6.75 $mm^2$. The overflow and the underflow from the hydrocyclone were collected and analysed.

The results were as follows:

| | Flow $cm^3$/min | Specific Gravity | Solids (g) | Solids (%) | Protein Content of Solids(%) |
|---|---|---|---|---|---|
| Overflow | 2730 | 0.68 | 6.45 | 9 | 85 |
| Underflow | 2330 | 0.95 | 55.9 | 91 | 10 |

The protein concentrate (overflow solids) was a very white colour.

EXAMPLE VII 9 kg of Hinoat groats were passed through the STURTEVANT roller mill of Example VI except that the roller gap was 0.05 mm and the groats were passed through the mill four times. The rolled groats were admixed with hexane for 30 minutes and passed through a SWECO VIBRO-ENERGY SEPARATOR equipped with a 60 and a 325 mesh screen. The specific gravity of the undersized material was adjusted to 0.80 using the procedure of Example VI. The resultant admixture was fed at a pressure of 565 kPa to a 10 mm hydrocyclone that was adjusted to give a ratio of overflow:underflow of 3:1. The overflow thus obtained was fed at a pressure of 317 kPa to a second 10 mm hydrocyclone. The underflow from the first hydrocyclone and the two flows from the second hydrocyclone were analysed. The results were as follows:

| Sample | Flow $cm^3$/min | Specific Gravity | Solids g/min | Solids (%) | Protein Content of Solids(%) |
|---|---|---|---|---|---|
| First UF | 580 | 1.12 | 479 | 49 | 3.4 |
| Second UF | 1575 | 0.81 | 434 | 44 | 20 |
| Second OF | 1820 | 0.68 | 67 | 7 | 83 |

Fractions having high and low protein content may be obtained from groats that have been comminuted using a roller mill equipped with smooth rollers.

EXAMPLE VIII 100 g of Hinoat groats obtained after five passes through a STURTEVANT roller mill at a roller gap of 0.075 mm were placed in a cylindrical extraction column fitted with a mechanical stirrer. The column was adapted to permit a continous flow of solvent between a lower (inlet) port and an upper (outlet) port in the column. The total height of the column was 40.6 cm with the height between ports being 30.5 cm. The columm had a diameter of 5.7 cm. 750 ml of hexane were added to the column and the resultant admixture was stirred at a rate such that a bran layer was formed in the lower 15 cm of the column, the remainder of the column being substantially free of bran.

Hexane was then passed through the column, from the lower port to the upper port, at a rate of 72 ml/min for a period of 18 minutes. The overflow from the column was collected and subsequently centrifuged for 10 minutes at 1500 G. The supernatant liquid of the centrifuged overflow sample was decanted off and the solids thus obtained (flour) were allowed to dry in air. The same procedure as used to separate solids (branny flour) from that part of the admixture remaining in the column. Oat oil was obtaind from the combined supernatant liquids using a rotary evaporator.

The results obtained were as follows:

| Sample | Weight (g) | Protein Content of Solids(%) |
|---|---|---|
| Groats | 100.0 | 20.7 |
| Flour | 39.6 | 24.7 |
| Branny Flour | 52.4 | 22.4 |
| Oil | 8.1 | — |

The flour was very white in appearance while the branny flour was buff coloured.

I claim:

1. A process for the separation of dehulled oats into fractions differing in composition, said process comprising:

(a) admixing comminuted dehulled oats with an organic solvent, said oats having been comminuted by passing dehulled oats between at least one pair of rollers, the rollers of each pair being smooth-surfaced rollers spaced apart at a distance of not more than 0.75 mm, at least one pair of rollers being spaced apart at a distance of 0.025–0.25 mm, and said solvent being a solvent for oil in the oats, and (b) separating the admixture of comminuted oats and solvent into at least two fractions, the solid components of said fractions differing in composition.

2. The process of claim 1 in which dehulled oats are passed between at least two pairs or rollers.

3. The process of claim 2 in which all pairs of rollers are spaced apart at a distance in the range of 0.025–0.25 mm.

4. The process of claim 3 in which all pairs of rollers are substantially equally spaced apart.

5. The process of claim 4 in which there are three pairs of rollers.

6. The process of claim 1 in which the surfaces of the rollers are $<10$ rms polished surfaces.

7. The process of claim 1 in which the solvent is selected from the group consisting of pentane, hexane, heptane, cyclohexane and alcohols of 1–4 carbon atoms.

8. The process of claim 7 in which, in step (b), the admixture is subjected to the influence of centrifugal force.

* * * * *